US005335787A

United States Patent [19]

Finchum et al.

[11] Patent Number: 5,335,787

[45] Date of Patent: Aug. 9, 1994

[54] FOOD AND BEVERAGE TRAY

[75] Inventors: John A. Finchum, Dunwoody; Timothy K. Sheehan, Woodstock, both of Ga.

[73] Assignee: Amoco Corporation, Chicago, Ill.

[21] Appl. No.: 965,335

[22] Filed: Oct. 23, 1992

Related U.S. Application Data

[63] Continuation of Ser. No. 763,113, Sep. 20, 1991, abandoned.

[51] Int. Cl.[5] ..... B65D 1/34

[52] U.S. Cl. ..... 206/564; 229/2.5 R; 206/518; 220/575; D7/553

[58] Field of Search ..... 206/562, 563, 564, 518, 206/519; 229/2.5 R, 904; 220/17.1, 507, 513, 516, 575; D7/553, 554

[56] References Cited

U.S. PATENT DOCUMENTS

| | | | |
|---|---|---|---|
| D. 52,278 | 8/1918 | Kraus | 220/575 |
| D. 199,991 | 1/1965 | McManamey | D7/553 |
| D. 200,249 | 2/1965 | Hancock | 229/2.5 |
| D. 204,071 | 3/1966 | Earl | D7/553 |
| D. 235,498 | 6/1975 | Day | D7/554 |
| D. 268,645 | 4/1983 | Phillips et al. | D7/554 |
| D. 301,820 | 6/1989 | Wasserman | D7/553 |
| D. 305,192 | 12/1989 | Van Erkel | D7/553 |
| 1,520,402 | 12/1924 | Clemans | 220/575 |
| 1,848,066 | 3/1932 | Shepard et al. | 229/2.5 |
| 3,601,277 | 8/1971 | Andrews | 206/564 |
| 3,675,811 | 7/1972 | Artz | 220/575 |
| 3,915,371 | 10/1975 | Crabtree | 206/564 |
| 3,942,671 | 3/1976 | Florian | 206/564 |
| 3,955,672 | 5/1976 | Brundage | 206/562 |
| 4,208,006 | 6/1980 | Bixler et al. | 206/564 |
| 4,219,144 | 8/1980 | Hagelberg | 206/564 |
| 4,607,758 | 8/1986 | Stevens | 206/563 |
| 4,852,738 | 8/1989 | Craig et al. | 206/564 |
| 4,874,083 | 10/1989 | Antoni et al. | 206/564 |
| 4,966,297 | 10/1990 | Doty | 206/564 |
| 4,967,908 | 11/1990 | Kessler | 206/519 |
| 4,989,742 | 2/1991 | Powell | D7/554 |
| 5,035,327 | 7/1991 | Denzin et al. | 206/518 |
| 5,071,008 | 12/1991 | Hradisky | 206/519 |

FOREIGN PATENT DOCUMENTS

| | | | |
|---|---|---|---|
| 1471281 | 3/1967 | France | 220/575 |

*Primary Examiner*—David T. Fidei

*Attorney, Agent, or Firm*—Matthew R. Hooper; Stephen L. Hensley

[57] ABSTRACT

A food and beverage tray for holding food and drink which is designed to be grasped in one hand of a user, wherein the user's thumb is placed on a thumb placement region on the upper surface of the tray and the user's remaining fingers grasp the tray along the bottom surface, which comprises a tray having a bottom comprising a beverage container recess and a continuous sidewall having a height which is lower adjacent to a beverage container recess located next to the thumb placement region.

13 Claims, 2 Drawing Sheets

FOOD AND BEVERAGE TRAY

This is a continuation of application Ser. No. 07/763,113, filed Sep. 20, 1991, now abandoned.

BACKGROUND OF THE INVENTION

This invention relates generally to food trays and more particularly to a tray designed so that a user can simultaneously support the tray and a beverage container thereon with a single hand, which comprises a tray having a bottom containing a beverage container recess and a continuous sidewall which is of lower height adjacent the container recess.

The problem of serving and consuming food and drinks at social functions where guests remain standing or do not have tables for holding plates and drinks is well known. The problem comes from guests having to hold a drink in one hand and a food plate in the other. With both hands occupied, it is difficult for the guests to shake hands or to eat or drink. One attempt to solve this problem is disclosed in U.S. Pat. No. 3,401,858, White, et al. issued Sep. 17, 1968. White discloses a service tray for holding food and drink capable of being held in one hand which has a bottom bounded by a vertical sidewall. The vertical sidewall has openings through which the thumb and index finger of the person may be inserted for grasping a beverage container supported on the bottom of the tray. Use of this tray can be uncomfortable and its manufacture requires expensive injection molding techniques or additional cutting steps to make the thumb and finger openings.

U.S. Pat. No. 4,744,597, Bauman et al., issued May 17, 1988, discloses a tray having a generally C-shaped sidewall and having two end edges opposite a container recess in the bottom surface of the tray, designed to permit a user to simultaneously grasp a beverage container between the users thumb and forefinger while grasping the underside of the tray with the user's remaining fingers. In the Bauman tray, the sidewall height is highest adjacent the container recess. Although the tray disclosed in Bauman is an admirable attempt to overcome this longstanding problem, it has several disadvantages when made from a web of sheet material, for example, a thermoplastic foam such as polystyrene foam. This tray is difficult to produce with any production process involving use of a web of material, as is customary with polystyrene foam, because of problems in trimming the disclosed sidewall surface. In addition, there is no disclosure in Bauman of the nestability and stacking of the disclosed tray nor does Bauman try to minimize what is called stacking cube or the volume of a specified number of stacked trays. The size of the stacking cube for a particular tray product is critical when using a solid or foam thermoplastic to produce the product because cube size greatly affects shipping economics and storage space requirements for thermoplastic products. Shipping cube is even more critical for foam trays, because foam trays will have a bigger cube than that for solid trays of the same design.

Manufacturing, marketing and use of trays also requires that trays are capable of stacking evenly without significant leaning of the stack. Trays must further be readily denested or unstacked by users. Neither White nor Bauman addresses these requirements.

It is an object of this invention to provide a food and beverage tray made from paper, pulp or thermoplastic which is designed to be held in one hand with a thumb on one surface of the tray and the remaining fingers on the bottom surface of the tray. It is another object of this invention to provide an improved food and beverage tray particularly suitable for production from a thermoplastic foam. It is yet another object to provide a food and beverage tray which has a minimized stacking cube. It is yet a further object to provide such a food and beverage tray which overcomes the problems of a significantly uneven or lopsided stack of trays and which is easily denested. The objects of the invention can be obtained through use of the food and beverage tray disclosed herein which comprises a bottom having an upper surface for supporting food items and an outer surface opposite the upper surface; a container recess formed in the bottom for supporting a beverage container; a continuous sidewall extending upwardly from the bottom which is of lower height adjacent the container recess; and a pair of thumb placement surfaces on the upper surface of the bottom and adjacent to the container recess, whereby the tray is adapted to permit a user to grasp the tray with a thumb on either of the thumb placement regions and the remaining fingers on the outer surface of the bottom.

SUMMARY OF THE INVENTION

The invention comprises an improved food and beverage tray for holding food and drink designed to be held in one hand which comprises a bottom having an upper surface and an outer surface opposite the upper surface; a container recess formed in the bottom; a continuous sidewall radially connected to and extending upwardly from the bottom and having a sidewall height which is lower adjacent the container recess; and at least one thumb placement surface adjacent to the container recess, whereby the tray is adapted to permit a user to grasp the tray with a thumb on the thumb placement region and the remaining fingers on the bottom's outer surface. In the preferred embodiment, the tray comprises a thermoplastic foam, and more preferably polystyrene foam, and contains a continuous flange on the top of the sidewall to improve manufacturing and a stacking lug means on the sidewall at the opposite end from the container recess to improve denesting and stacking of the product. Preferably, the tray also comprises a rib separating the container recess from the food containing area of the tray, wherein the rib's underside surface at its intersection with the sidewall is located at no more than one-half of the height of the overall height of the tray. Use of a dividing rib having an underside surface that at its intersection with the sidewall is no greater than one-half of the overall height of the tray improves the strength and stability of a thermoplastic foam tray of the invention significantly. The preferred tray of the invention has the important feature that it can be manufactured at high rates from a continuous web of material, by thermoforming of a foam sheet, for example.

DESCRIPTION OF THE PREFERRED EMBODIMENTS

The invention broadly comprises a food and beverage tray designed to be grasped by the user in one hand whereby the user places his or her thumb on a thumb placement region of the tray and their remaining fingers underneath the tray, which comprises a bottom having an upper food containing surface; a container recess in said bottom for holding a beverage container; at least one thumb placement region next to the container recess; and an outer sidewall around the periphery of the bottom, wherein the sidewall is continuous without end edges and is of a lower overall height opposite the container recess and the thumb placement region to permit the user to grasp the tray at that point. Preferably, the tray of the invention comprises one thumb placement region on each side of the container recess and a continuous flange at the top of the sidewall. Use of the inventive tray having a continuous sidewall with a flange permits easier production by thermoforming of a sheet material and then trimming to produce the finished product. The invention thus overcomes a significant disadvantage of the tray disclosed in U.S. Pat. No. 4,744,597. Although the tray of the invention can be produced from any material, including paper pulp or thermoplastics such as polystyrene or polypropylene, it is particularly suited for production from a thermoplastic foam which is preferably a polystyrene foam. In the preferred embodiment of the tray of the invention, the shipping cube for the trays of the invention made from polystyrene is significantly minimized, thereby favorably affecting overall economics for the product.

Figure 1:
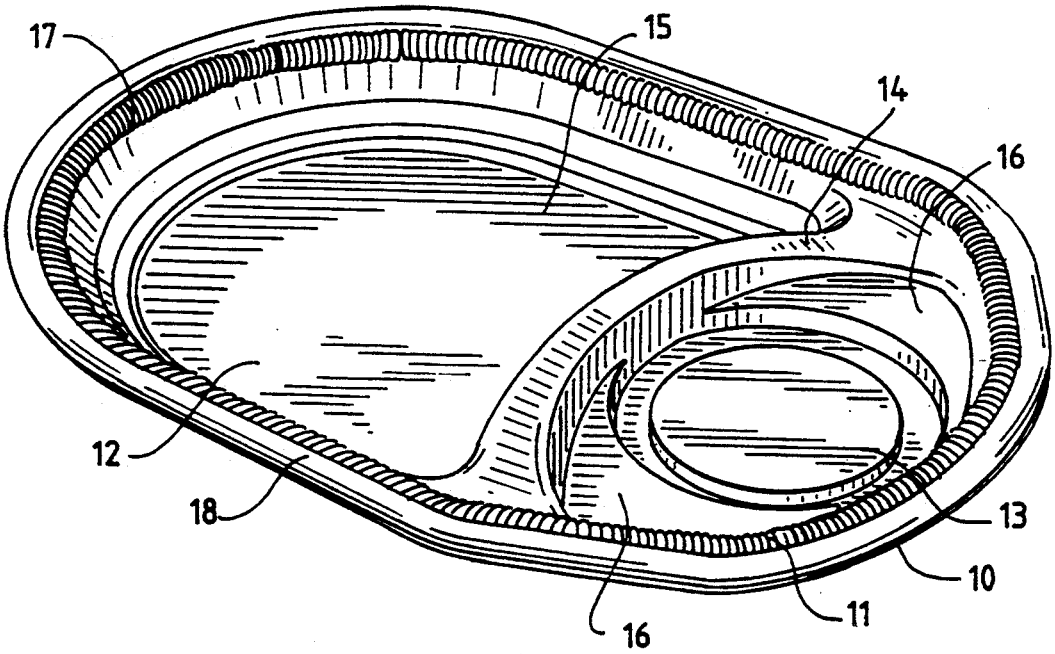
FIG. 1 is a perspective view of a preferred tray of the invention.

The tray of the invention can best be illustrated by reference to the drawings. FIG. 1 shows in perspective view the preferred embodiment of the tray of the invention. It depicts tray 10 having a bottom 12 having a continuous radial edge around its periphery, which transitions into a continuous sidewall 11 around the periphery of the bottom, a beverage container recess in the bottom tray 13, a divider rib 14 separating food containing area 15 from the beverage container recess area and two thumb placement regions 16 adjacent the beverage container recess. The food containing area 15 is preferably sized to hold a typical hamburger sandwich. The continuous sidewall 11 around the periphery of the bottom of the tray has a flange 18 radially connected at its top and is at its lowest height adjacent the thumb placement region 16 and the beverage container recess 13, The sidewall preferably connects to the bottom with a gradual slope because this improves tray strength and appearance. The angle of the sidewall, measured from the vertical, also preferably becomes greater near the flange to provide a surface for ornamentation or printing. The sidewall is thus preferably embossed 17 near the flange for decorative purposes.

The tray of the invention is held by a user as follows: at the lowest point on the tray's sidewall, adjacent the container recess and directly opposite the dividing rib that separates the drink and food sections of the tray, the sidewall will comfortably fit between the user's thumb and index finger of the same hand. The height of the sidewall at the lowest point of its radius adjacent to the drink holder section is such that it provides a gripping surface that rests between the inside rear of the thumb and palm of the hand just below the index finger.

The two substantially flat thumb placement surfaces 16 are preferably located on each side of the round shaped container recess designated for the drink. The flat areas are sized to accommodate the thumb of an adult or any person with smaller hands. Although use of only one thumb placement region is possible, the use of a pair of thumb placement surfaces is preferred because this permits either right or left hand use.

The height of the sidewall adjacent to the drink holder section of the tray is designed to facilitate usage. The difference between the sidewall height and the height of the thumb placement surface is set so that a user can comfortably hold the tray in one hand. Preferably, the difference between the height of the sidewall adjacent the container recess and the height of the thumb placement surface is in the range of about 0.125 to about 0.5 inches to achieve comfortable use, and more preferably about 0.25 inches.

Users handle the tray by placing a portion of their thumb on the flat thumb placement surface. The remaining portion of the thumb also contacts the tray by pressing against the upwardly transitioning sidewall. The index finger and remaining fingers are positioned on the underside of the container recess section of the tray. As the top portion of the thumb is pressed against the upwardly transitioning sidewall, the rear portion of the thumb or side of hand is pressed against the cup or can containing the beverage. By this method, the bottom surface of the cup or can, opposite the side of the cup or can that is in contact with the users hand, is firmly forced against the side of the container recess. As a result, the cup or can is stabilized and resistant to movement or spillage. The user will securely support the underside of the tray with the remaining four fingers. As the thumb is pressed against the sidewall, most users will also push slightly upward with the remaining fingers resulting in the tray being pinched and stabilized between the thumb, palm of hand and fingers. The under-sidewall of the container recess section can also be gripped by the four fingers positioned on the underside of the tray. By gripping the under-sidewall of the container recess, the tray can be pulled tightly against the palm of the hand.

Figure 2:
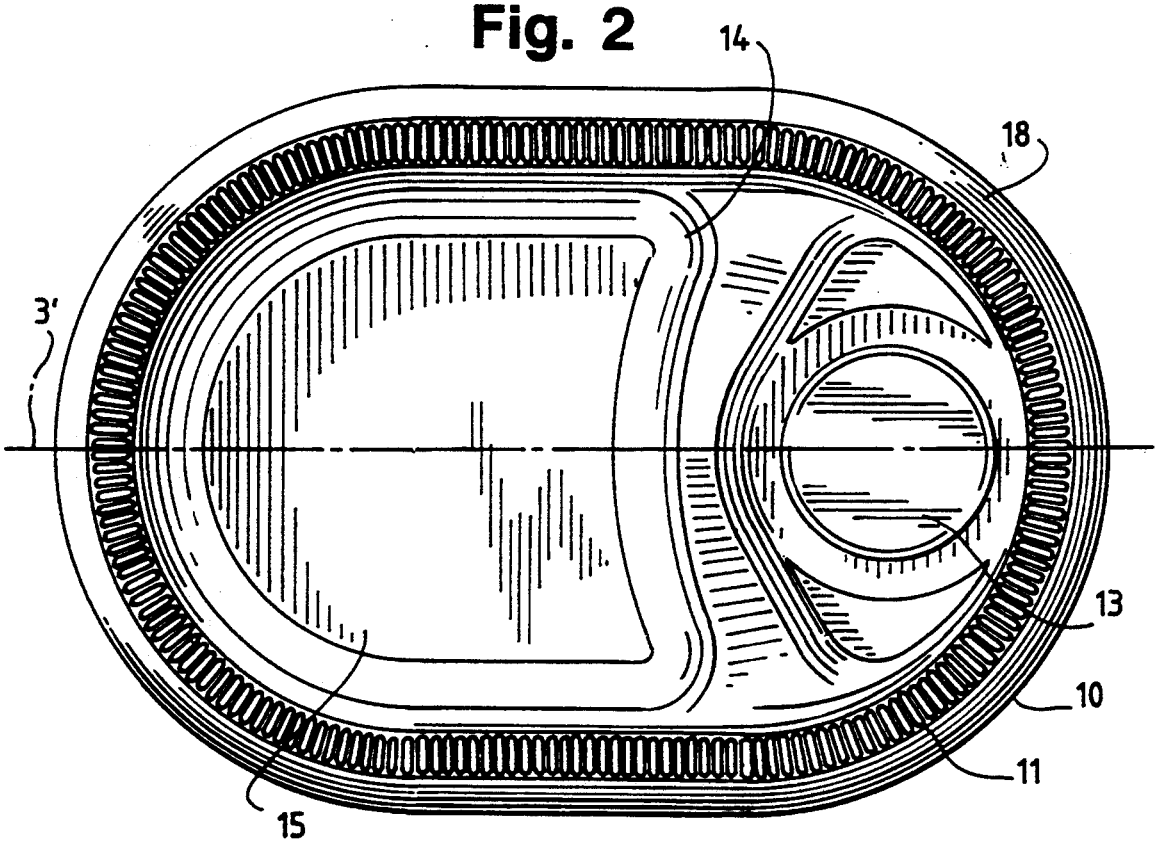
FIG. 2 is a top view of the preferred tray of the invention.

FIG. 2 is a top view of the preferred tray of the invention, again showing the tray 10 having the bottom 12, the continuous sidewall 11 having flange 18, the divider rib 14, thumb placement regions 16, beverage container recess 13 and the food containing region 15. Rib 14 is somewhat arcuate in shape in this view for improved tray strength and aesthetic purposes, although other rib configurations are possible. Line 3' down the middle of the tray in FIG. 2 is used to show the cross section displayed in FIG. 3. Rib 14 is preferably not of even height across the tray, and has a pinnacle at where line 3' crosses the rib. This means the rib intersects sidewall 11 at a lower height than the height of a rib at line 3'. Use of such a rib, as described below, is preferred because of higher tray strength.

Figure 3:
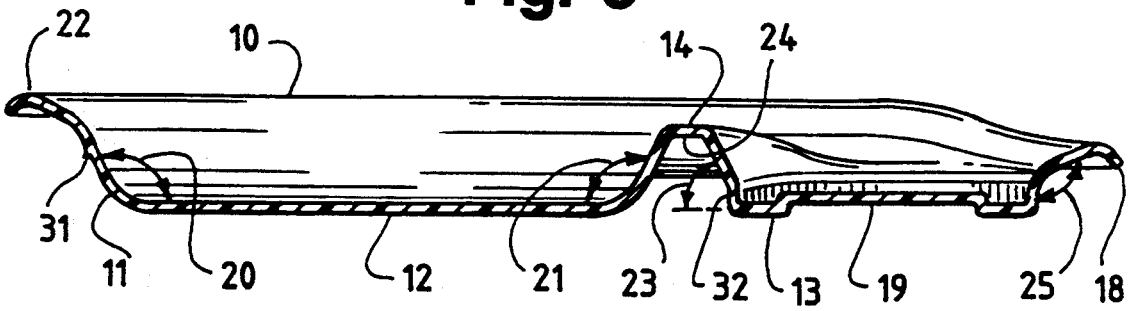
FIG. 3 is a cross sectional view along the center line of the preferred tray of the invention.

FIG. 3 illustrates a significant element of the preferred embodiment, which is designed to minimize the shipping cube of the tray of the invention and to eliminate uneven or lopsided stacking problems. FIG. 3 depicts the preferred tray of the invention having food containing area, bottom surface 12, sidewall 11 having flange 18, divider rib section 14, beverage container recess 13, and a stacking lug means 31 for improving the nestability and shipping cube of the product. When used, the stacking lug element levels off and prevents any significant curvature of a stack of trays, thus avoiding an uneven stack. The stacking lug 31 is sized and located to produce a level stack of the tray of invention, and is preferably formed in the sidewall during thermoforming to produce the tray. The beverage container recess 13 also has an underside surface 19 which is recessed from the outer surface of the bottom.

FIG. 3 also shows various radii and angle of the tray surfaces which are designed to improve appearance, strength and use of the tray of the invention. Radii of the curvatures 20 and 21 are preferably the same and are the radius of the transition from the bottom to the sidewall. Preferably radii of curvatures 20 and 21 are gradual for improved tray strength and are in the range of about 0.375 to about 0.75 inches. Radius 22 is at the transition of the flange 18 from the sidewall 11, and is set to match a user's thumb. The radius at point 22 is preferably about 0.125 to about 0.25 inches. Angle 23 is the transitioning sidewall between the container recess 13 into the underside of rib 14. Angle 23 is preferably about 20 to about 30 degrees. Radius of curvature 25 is matched to be comfortable to a user's thumb, and is preferably about 0.70 to about 0.90 inches.

Figure 4:
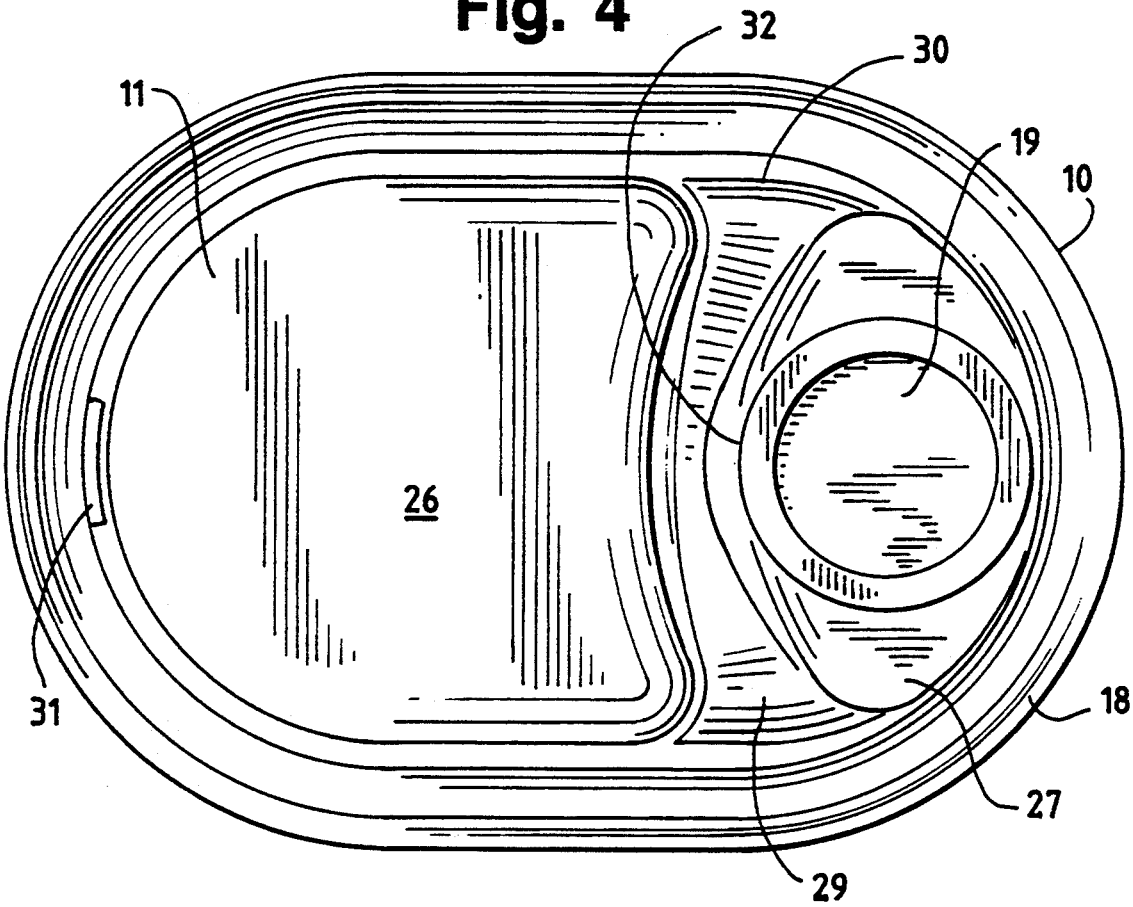
FIG. 4 is a bottom view of the preferred tray of the invention.

FIG. 4 is a bottom view of the preferred tray in the invention. Here tray 10 contains sidewall 11, bottom surface of the food containing section 26, bottom surface 19 and under-sidewall surface 32 of the beverage container recess, bottom surface of the thumb placement regions 27, bottom surface 29 of the rib, and stacking lug 31. Another important feature is the radius at point 30 at the transition of the rib into the sidewall. Tests showed that having a sharp radius at point 30 resulted in trays of lesser strength. Applicants thus prefer to have radius at point 30 in the range of about 0.25 to about 0.35 inches. The height of under surface 20 of the rib is another important aspect of the preferred embodiment of the tray of the invention. Referring to FIG. 3, the overall height measured from the bottom of the tray up to the underside of the rib at the intersection with the sidewall is no more than one-half of the overall height of the tray. In this regard, the overall tray height is measured from the outer surface of the bottom up to the top of sidewall around the food containing area of the tray. With trays of the invention produced from polystyrene foam, Applicants' tests showed that if the rib were formed so that the height of the rib's underside near the intersection with the sidewall was more than one-half of overall tray height, the tray was insufficiently stable for comfortable use. Thus, for a preferred tray having an overall height of about 0.98 inches, the height of the rib's underside near the sidewall preferably is about 0.43 inches.

The overall outer shape of the preferred tray of the invention is generally rectangular with arcuate ends near the beverage container recess and at the end opposite the beverage container recess. However, any desirable tray shape can be used provided the continuous sidewall has its lowest height adjacent to the beverage container recess. The sidewall height adjacent the recess is preferably in the range set out above which achieves comfortable use and is also preferably about one-half of the sidewall height surrounding the food containing area. Although other configurations are possible, Applicants prefer for aesthetic and food holding purposes to have a uniform sidewall height around the food containing area.

The beverage container recess formed in the tray bottom is preferably sized to hold typical 12 ounce beverage cans and typical disposable cups. Thus, although other shapes are possible, the container recess is preferably round shaped and preferably contains a raised round portion on the upper surface of the recess designed to fit into the bottom of a beverage can or cup, which are typically recessed. The raised portion significantly aids in stabilizing the beverage container on the tray. The outer surface of the beverage container recess is preferably co-planar with the outer surface of the food containing area of the tray to produce a level tray. The inside wall of the beverage container recess is also tapered from the vertical by about 7 degrees, since this helps stabilize the beverage container on the tray. Applicants also prefer to minimize the well depth of the beverage container recess because testing showed this minimizes the overall stack height of the tray of the invention. The well depth is the distance between the thumb placement surface and the top of the lowest part of the container recess. It is desirable to minimize stack height because the stack height will determine the shipping cube and storage space requirements of the product. Applicants, therefore, prefer to use a well depth of approximately 0.030 inches, since tests have shown this is sufficient to permit a user to hold the tray of the invention while stabilizing a beverage container on the tray.

Preferably, the wall thickness of the container recess is less than that for the remainder of the tray, because trays with reduced wall thickness in the recess have improved denesting and even stacking and lower shipping cube. Thus, the wall thickness in the container recess is preferably about 30 to about 50 percent less thick than the remainder of the tray.

Directly opposite the beverage container region on the outer surface of the sidewall is preferably located the stacking lug 31. The stacking lug is located at a height on the sidewall which is dependent upon the overall well depth of the beverage container recess. When using the preferred well depth in the container recess, the stacking lug is located at approximately one-half of the overall height of the tray, which is about 1 inch for the preferred tray.

The flange 18 shown in the preferred embodiment is designed so that the curvature of the sidewall into the flange matches the curvature of a user's thumb so that a user is not required to bend his/her wrist at an uncomfortable angle when grasping the tray. The flange also allows production using a web-forming process and thermoforming wherein the finished products are trimmed after thermoforming of the web. This overcomes another disadvantage of the tray depicted in U.S. Pat. No. 4,744,597.

The tray of the invention can be made from any suitable material, such as paper, pulp, or thermoplastic, either foam, solid, or laminated, using any suitable production process. The tray is particularly suited for manufacture from a thermoplastic using a sheet production and thermoforming process, and preferably comprises polystyrene. Polystyrene is particularly suitable when the tray is used as a disposable product, because polystyrene is readily recycled.

In the preferred embodiment of the invention, the tray comprises a polystyrene foam laminate comprising a core layer of polystyrene foam and a laminate layer of polystyrene as the outer surface of the bottom of the tray and a separate laminate layer of polystyrene as the upper surface of the tray. The foam-core laminate sheet used to produce such trays of the invention can be produced by any suitable method and preferably by the method disclosed in U.S. Pat. No. 3,669,794. Any thickness of laminate can be used. The upper and lower laminate layers can have the same or different thickness, and are preferably about 0.004 to about 0,006 inch thick. The foam core is the bulk of the laminate thickness. However, the overall thickness of the laminate is preferably in the range of about 0.060 to about 0.090 inches, since laminates of this thickness can be formed into trays of sufficient stability. In the preferred laminate, the weight of the foam core layer is preferably in the range of 5 grams of polystyrene foam per 100 square inches of surface area to about 9 grams of foam per 100 square inches of surface area, as measured on an unexpanded foam sheet of about 0.060 to about 0.090 inches thickness. Applicants prefer furthermore to have the upper laminate layer be heavier, such as about double the weight of the lower laminate layer on the bottom surface, to provide improved resistance to food acids. Preferably, the weight of the solid upper layer is about 6.0 to about 10.0 grams per 100 square inches and is about 3.0 to about 5.0 grams per 100 square inches for the solid lower (outer) layer.

The tray of the invention is particularly suitable for production by thermoforming a web of sheet material. This results in a significant advantage compared to the trays disclosed by Bauman in that manufacture of the tray involves a simple two step manufacturing process involving thermoforming of the sheet material followed by trimming to produce the final trays. Any suitable thermoforming process can be used to produce the tray of the invention, wherein the thermoforming temperature and conditions closely match the sheet material used to form the tray. Thermoforming processes for polystyrene foam trays are well known to those skilled in the art and any suitable process and conditions employing a mold shaped to produce the tray of the invention can be used.

In another embodiment of the tray of the invention, a lid covering the food containing portion of the tray can be included. In this embodiment, it is also possible to include lid holding means on the sidewall or rib of the tray. This embodiment permits caterers, for example, to prepare food for functions ahead of time, place food in the tray and cover the food with the lid, and then provide them for distribution at the function. The lid in this embodiment can be produced from any desirable material and preferably is a clear polystyrene material so that after use both the lid and the preferred polystyrene foam tray are readily recycled together.

Although the present invention has been described with particular reference to the preferred embodiment pictured in the figures, the present invention is defined by the following claims and various modifications and changes may be made to the inventive concepts of the tray of the invention.

We claim:

1. A food and beverage tray designed so that a user can simultaneously support the tray and a beverage container thereon comfortably with a single hand, said tray comprising a bottom having an upper bottom surface and an outer bottom surface opposite the upper surface; a food containing area; a beverage container recess formed in the bottom; at least one thumb placement surface next to the container recess; and a continuous sidewall radially connected to the bottom with a sidewall outer surface which transitions to the outer surface of the bottom and a continuous flange located on an upper end of the sidewall, said flange extending outwardly toward the outer perimeter of the tray from said continuous sidewall and away from said food containing area and said beverage container recess, and said continuous sidewall being downwardly angled in the region of said container recess so as to form said thumb placement surface, there being a difference in height between the height of the sidewall adjacent the beverage container recess and the height of the sidewall at the thumb placement surface, such that said height of the sidewall adjacent said beverage container recess is about 0.125 to about 0.50 inches greater than said height of the sidewall at the thumb placement surface, where said sidewall height is the distance from the top surface of said sidewall to said outer bottom surface.

2. The food and beverage tray of claim 1 including a stacking lug means located on an outer surface of the sidewall at a part Of the tray adjacent the food containing area and opposite the container recess.

3. The food and beverage tray of claim 1 further comprising a dividing rib separating the beverage container recess from the food containing area of the tray where said rib has an undersurface which at its intersection with the sidewall has a height no more than about one-half of the overall height of the tray when measured from the bottom of the tray and wherein said rib extends from a first said sidewall on one side of the tray to an opposing sidewall on the other side of said tray, and said rib has a height which is higher than the height of said rib at said sidewall intersection, said heights being measured from the bottom of the tray.

4. The food and beverage tray of claim 1 comprising thermoplastic or thermoplastic foam.

5. The food and beverage tray of claim 1 comprising a foam laminate comprising a polystyrene foam core layer and upper and lower layers of polystyrene

6. The food and beverage tray of claim 5 wherein the upper layer has a density greater-than the density of the lower layer.

7. The food and beverage tray of claim 1 wherein the beverage container recess has a raised portion on its undersurface sized to fit into the bottom of a beverage can having a recessed bottom.

8. The food and beverage tray of claim 1 comprising paper pulp.

9. A food and beverage tray designed so that a user can simultaneously support the tray and a beverage container thereon comfortably with a single hand, said tray comprising a bottom having an upper bottom surface and an outer bottom surface opposite the upper surface; a food containing area: a beverage container recess formed in the bottom; a thumb placement region on each side of the container recess; a continuous sidewall radially connected to the bottom with a sidewall outer surface which transitions to the outer surface of the bottom and a continuous flange located on an upper end of the sidewall and being downwardly angled in the region of said container recess such that said continuous sidewall has a height adjacent the container recess and thumb placement region which is lower than said height adjacent the food containing area, said sidewall height being defined as the vertical distance between said continuous flange of said sidewall and the plane occupied by said outer bottom surface of said food containing area whereby the tray is adapted to comfortably permit a user to grasp the tray with a thumb of one hand on the thumb placement region and with remaining fingers of the same hand on the outer surface of the bottom of the tray; said tray further comprising a stacking lug means on an outer surface of the sidewall; and a rib separating the container recess from a food containing area of the tray.

10. The food and beverage tray of claim 9 comprising a thermoplastic or thermoplastic foam.

11. The food and beverage tray of claim 9 comprising paper pulp.

12. The food and beverage tray of claim 9 comprising polystyrene foam.

13. The food and beverage tray of claim 9 wherein said rib extends from a first said sidewall on one side of the tray to an opposing sidewall on the other side of said tray, and said rib has a height which is higher than the height of said rib at the intersection thereof with said sidewalls, said heights being measured from the bottom of the tray.

* * * * *